US011492181B2

(12) United States Patent
Sims et al.

(10) Patent No.: US 11,492,181 B2
(45) **Date of Patent: *Nov. 8, 2022**

(54) LUG CLOSURE

(71) Applicant: Crown Packaging Technology, Inc., Alsip, IL (US)

(72) Inventors: Bart Sims, Amanda, OH (US); Galen German, Somerset, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 225 days.

This patent is subject to a terminal disclaimer.

(21) Appl. No.: 16/890,237

(22) Filed: Jun. 2, 2020

(65) Prior Publication Data

US 2020/0290780 A1 Sep. 17, 2020

Related U.S. Application Data

(63) Continuation of application No. 15/504,418, filed as application No. PCT/US2015/046107 on Aug. 20, 2015, now Pat. No. 10,676,250.

(60) Provisional application No. 62/039,689, filed on Aug. 20, 2014.

(51) Int. Cl.
*B65D 43/02* (2006.01)
*B65D 1/02* (2006.01)

(52) U.S. Cl.
CPC ..... *B65D 43/0231* (2013.01); *B65D 1/0246* (2013.01); *B65D 2543/00092* (2013.01); *B65D 2543/00277* (2013.01); *B65D 2543/00527* (2013.01); *B65D 2543/00537* (2013.01); *B65D 2543/00972* (2013.01)

(58) Field of Classification Search
CPC ..... B65D 43/0231; B65D 1/0246; B65D 2543/00092; B65D 2543/00277; B65D 2543/00527; B65D 2543/00537; B65D 2543/00972
USPC ..... 215/333
See application file for complete search history.

(56) References Cited

U.S. PATENT DOCUMENTS

| | | | |
|---|---|---|---|
| 3,465,908 | A | 9/1969 | Acton et al. |
| 3,788,508 | A | 1/1974 | Vercillo |
| 10,676,250 | B2 | 6/2020 | Sims et al. |
| 2007/0144999 | A1 | 6/2007 | King |
| 2012/0118899 | A1 | 5/2012 | Wurster et al. |

(Continued)

FOREIGN PATENT DOCUMENTS

| | | | |
|---|---|---|---|
| DE | 102008007301 | A1 | 8/2009 |
| GB | 445744 | A | 4/1936 |
| GB | 453101 | A | 9/1936 |

(Continued)

*Primary Examiner* — James N Smalley
(74) *Attorney, Agent, or Firm* — Condon Roccia Koptiw LLP

(57) ABSTRACT

A lug closure includes a central top panel, an annular channel outboard of the top panel, a downwardly extending skirt outboard of the channel, the skirt terminating at an inward curl that defines a curl height, and lugs formed in the curl. Each one of the lugs includes a body that extends radially inwardly from the skirt. The body includes a leading edge that merges into a leading portion of the curl. The leading edge tapers in thickness from the curl height to a minimum lug thickness and forms a leading edge vertical taper angle from horizontal between 6 and 15 degrees. A trailing edge merges into a trailing portion of the curl and the trailing edge tapers in thickness from the curl height to the minimum lug thickness.

12 Claims, 22 Drawing Sheets

(56) References Cited

U.S. PATENT DOCUMENTS

2014/0263339 A1 9/2014 Bates et al.

FOREIGN PATENT DOCUMENTS

WO 2006081943 A1 8/2006
WO 2009115377 A1 9/2009

LUG CLOSURE

CROSS-REFERENCE TO RELATED APPLICATIONS

This application is a continuation of U.S. patent application Ser. No. 15/504,418, filed Feb. 16, 2017, which is the National Stage Application of International Patent Application No. PCT/US2015/046107, filed Aug. 20, 2015, which claims the benefit of U.S. Provisional Patent Application Ser. No. 62/039,689 filed Aug. 20, 2014, the disclosures of which is hereby incorporated by reference as if set forth in its entirety herein.

BACKGROUND

Many foods and beverage bottles have a large mouth and are sealed with a metal or composite closure. For example, sauces have traditionally been packaged in glass containers with an all metal closure. Other food products, such as jelly and beverages have been packaged in blow molded plastic bottles and sealed with composite closures. The food or beverage contents of large mouth, blow molded plastic bottles are often filled in a process in which the contents are at an elevated temperature at the time of filling, often over 180 degrees F., referred to as "hot-fill." A closure is applied while the contents are hot to hermetically seal the container. The term "large mouth" as used in this disclosure is any container mouth having a closure size greater than 48 mm.

Composite closures typically include a metal disk for sealing the mouth of the container and a plastic skirt, which fits over the disk, for engaging the threads of the bottle. Composite closures are typically used for hot fill applications with plastic bottles because the metal disk provides a robust seal and good heat transfer among other benefits.

Single piece, all-metal closures are commercially available in several types. An all-metal, unitary screw-on closure has threads preformed in the skirt that correspond to the bottle threads. A ROPP (roll on pilfer proof) closure has threads formed during application of the closure to the bottle. Crown Cork & Seal, Inc. manufacturers an all-metal, 2-piece lugged closure under the trade name Orbit™. Another type of all-metal, unitary closure is a one-piece lugged closure having lugs formed on the bottom of the skirt to engage threads on a bottle neck.

Typically, lug closures are used only with either glass bottles or with plastic bottles in which the lug closure is applied as part of a cold filling process (that is, neither the contents nor the bottle is at an elevated temperature during filling). But lug closures are not often used with conventional hot-filled plastic bottles without crystallized neck finishes because of a particular problem. The hot-fill contents raise the temperature of the neck and finish of the bottle, which diminishes the hoop strength of the finish. Because lug closures only contact the finish at the lugs, the force of applying the lug closure to the finish distorts the shape of the finish. Because four lug closures are typical for closure sizes less than 77 mm, the problem is known as "squaring," even though the term "squaring" is used herein for distortion by closures having other quantities of lugs. When the container cools, the squaring is set. The problem is especially prevalent in bottles having either a blow molded or injection molded finish when neither are crystallized as part of the container manufacturing process.

SUMMARY

The present invention includes a lug closure that, in a preferred embodiment, has lugs that are flexible and shaped such that they have less tendency to dig into the container thread and can diminish a horizontal force pushing inward toward the axis of the container. In this regard, the lug taper angle is generally greater than that of conventional metal closures (except for flexible lugs on some closures used for glass containers). And the lug taper angle roughly matches or is close to the thread pitch angle.

Moreover, the container thread profile is designed to enhance flatness of the lug contact surface relative to the thread engagement face to minimize the inward force on the container. And the thread may have an angle-flat finish with a relatively flat thread engagement face on which the closure comes to its final position once tightened. The closure can have deep and narrow compound channel that can trap the container finish and maintain a round seal surface.

In some embodiments, a lug closure includes a central top panel, an annular channel outboard of the top panel, a downwardly extending skirt outboard of the channel, the skirt terminating at an inward curl that defines a curl height, and lugs formed in the curl. Each one of the lugs includes a body that extends radially inwardly from the skirt. The body includes a leading edge that merges into a leading portion of the curl. The leading edge tapers in thickness from the curl height to a minimum lug thickness and forms a leading edge vertical taper angle from horizontal between 6 and 15 degrees. A trailing edge merges into a trailing portion of the curl and the trailing edge tapers in thickness from the curl height to the minimum lug thickness.

In some embodiments, a package for food or beverage contents includes a wide mouth plastic (PET, polypropylene) hot Tillable container. The container has a finish including threads and at least an upper portion of the threads define a thread pitch angle. The package further includes a lug closure comprising a central top panel, an annular channel outboard of the top panel, a downwardly extending skirt outboard of the channel that terminates at an inward curl that defines a curl height, and lugs formed in the curl. Each one of the lugs includes a body that extends radially inwardly from the skirt. The body includes a leading edge that merges into a leading portion of the curl. The leading edge tapers in thickness from the curl height to a minimum lug thickness. The leading edge taper is within eight degrees of the thread pitch angle of the finish. A trailing edge merges into a trailing portion of the curl and tapers in thickness from the curl height to the minimum lug thickness.

DETAILED DESCRIPTION OF ILLUSTRATIVE EMBODIMENTS

Figure 1A:
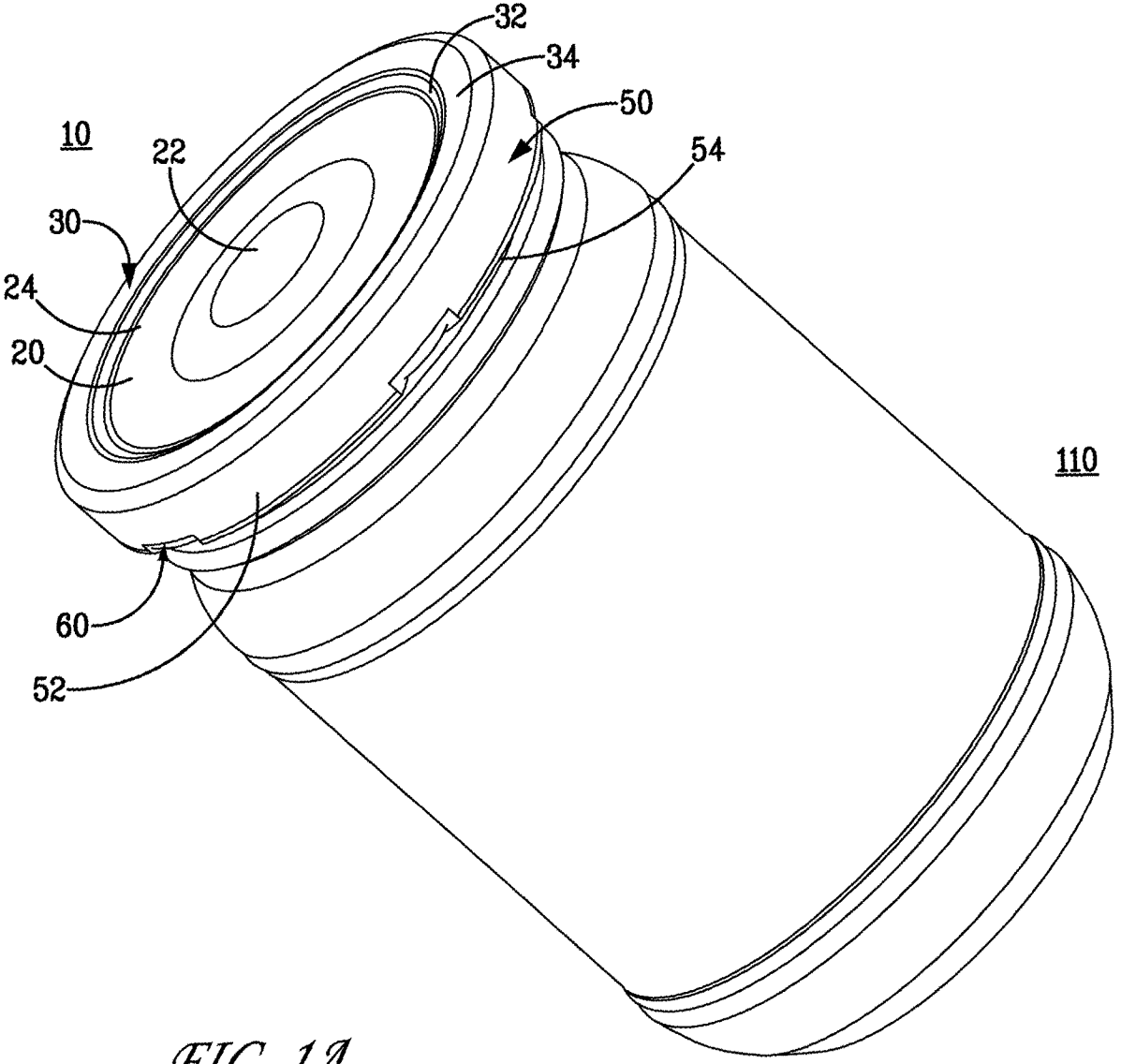
FIG. 1A is a perspective view of a package having a closure and corresponding threads according to some aspects of the present invention.
Figure 1B:
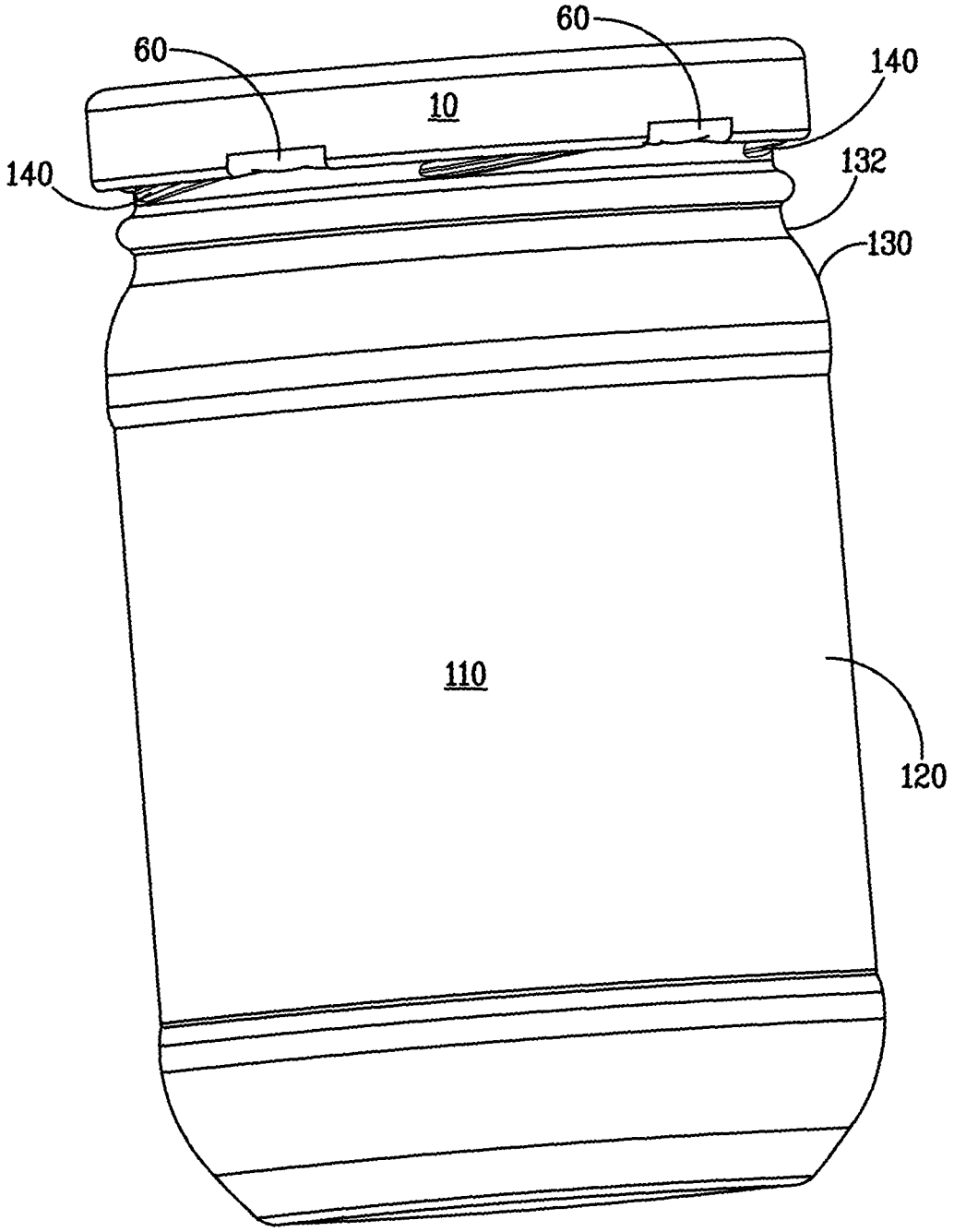
FIG. 1B is another perspective view of the package of FIG. 1A.
Figure 1C:
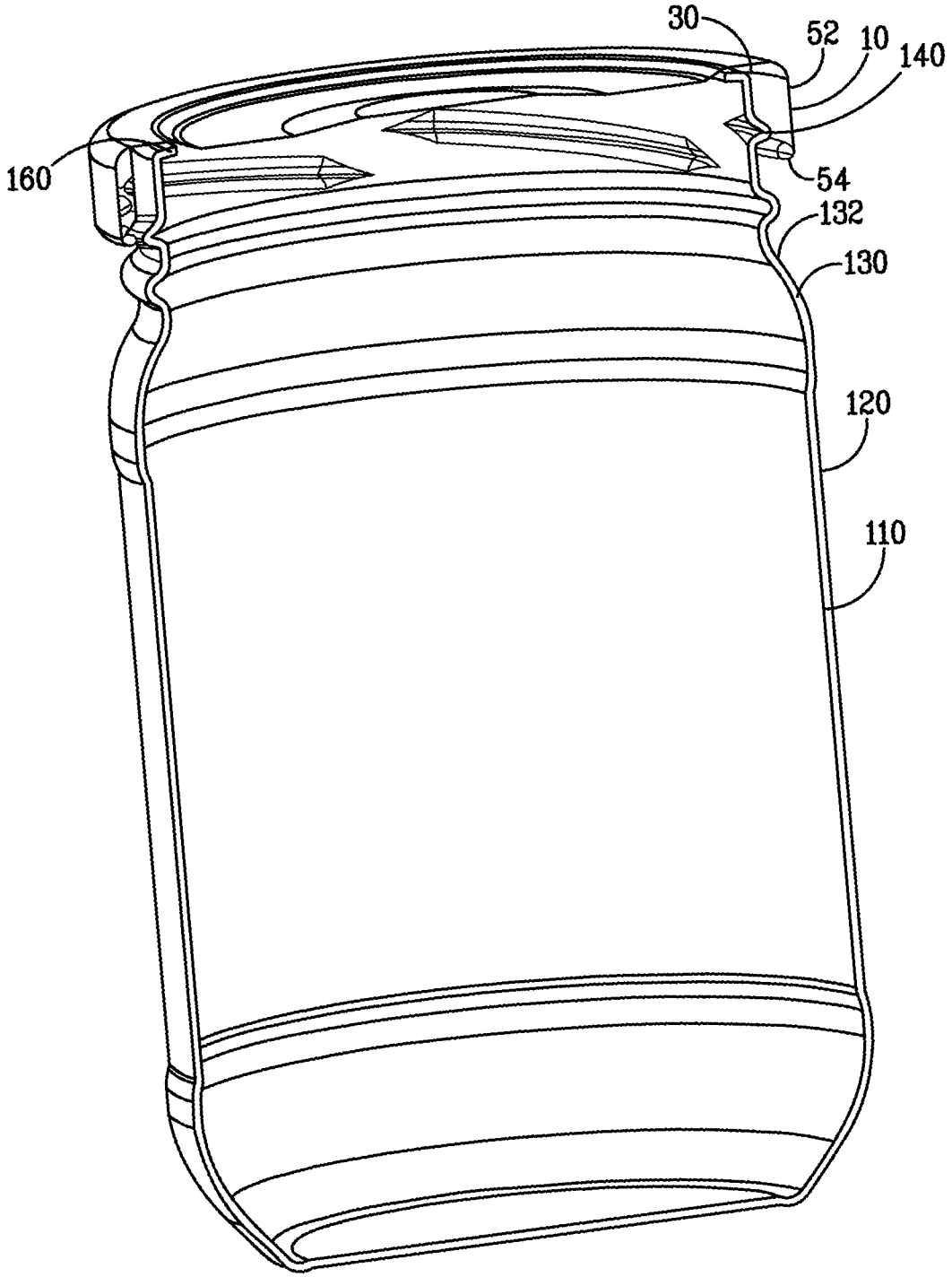
FIG. 1C is a partial cross sectional view of the package of FIG. 1A.

FIGS. 1A, 1B, and 1C illustrate a package that includes a closure 10 and a container 110. Closure 10 includes a top panel 20, a channel 30, a skirt 50, and five lugs 60. Container 110 includes a body 120, a neck 130, threads 140, and a rim 160.

Figure 7A:
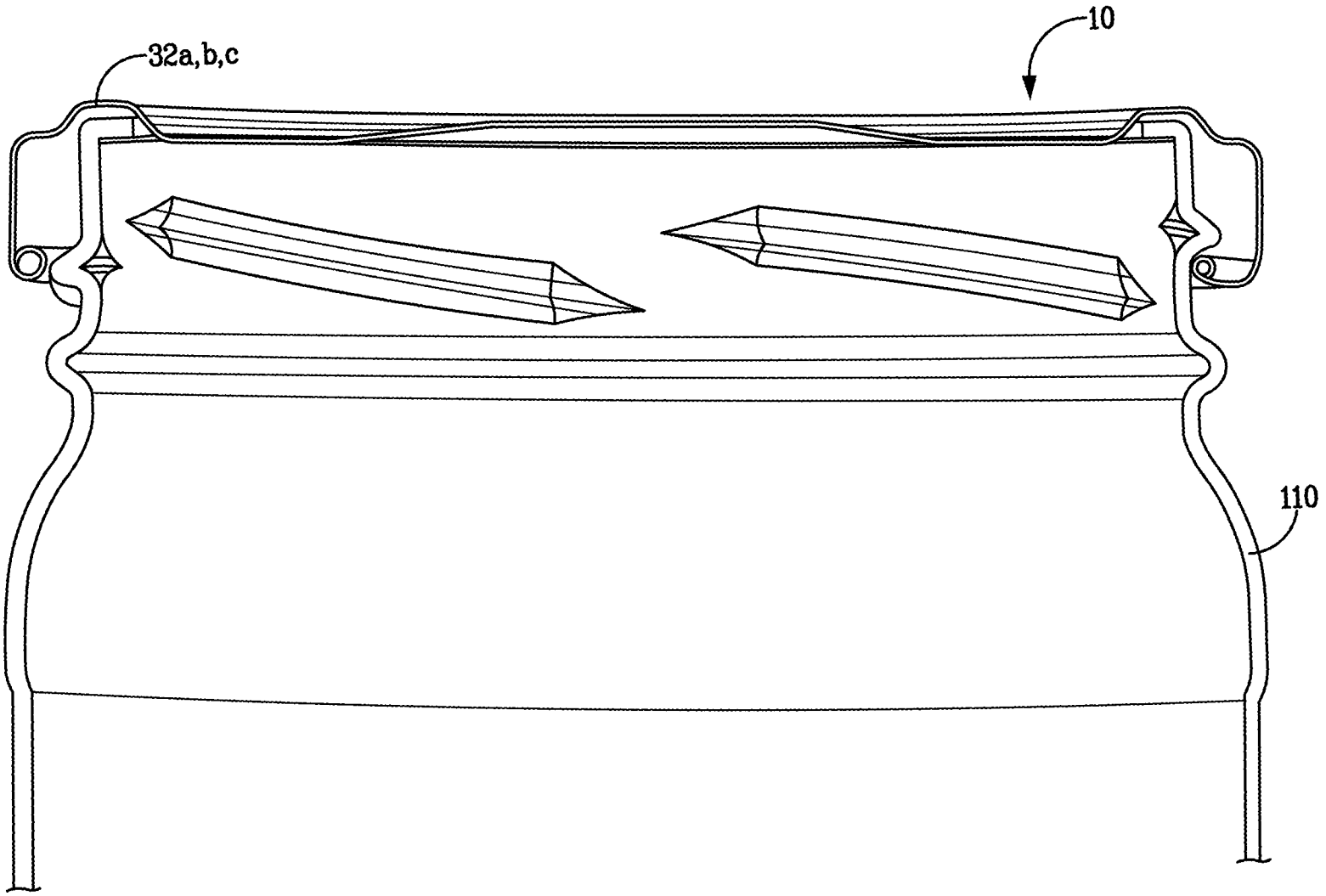
FIG. 7A is an enlarged cross section of a package having a container and a corresponding closure.
Figure 7B:
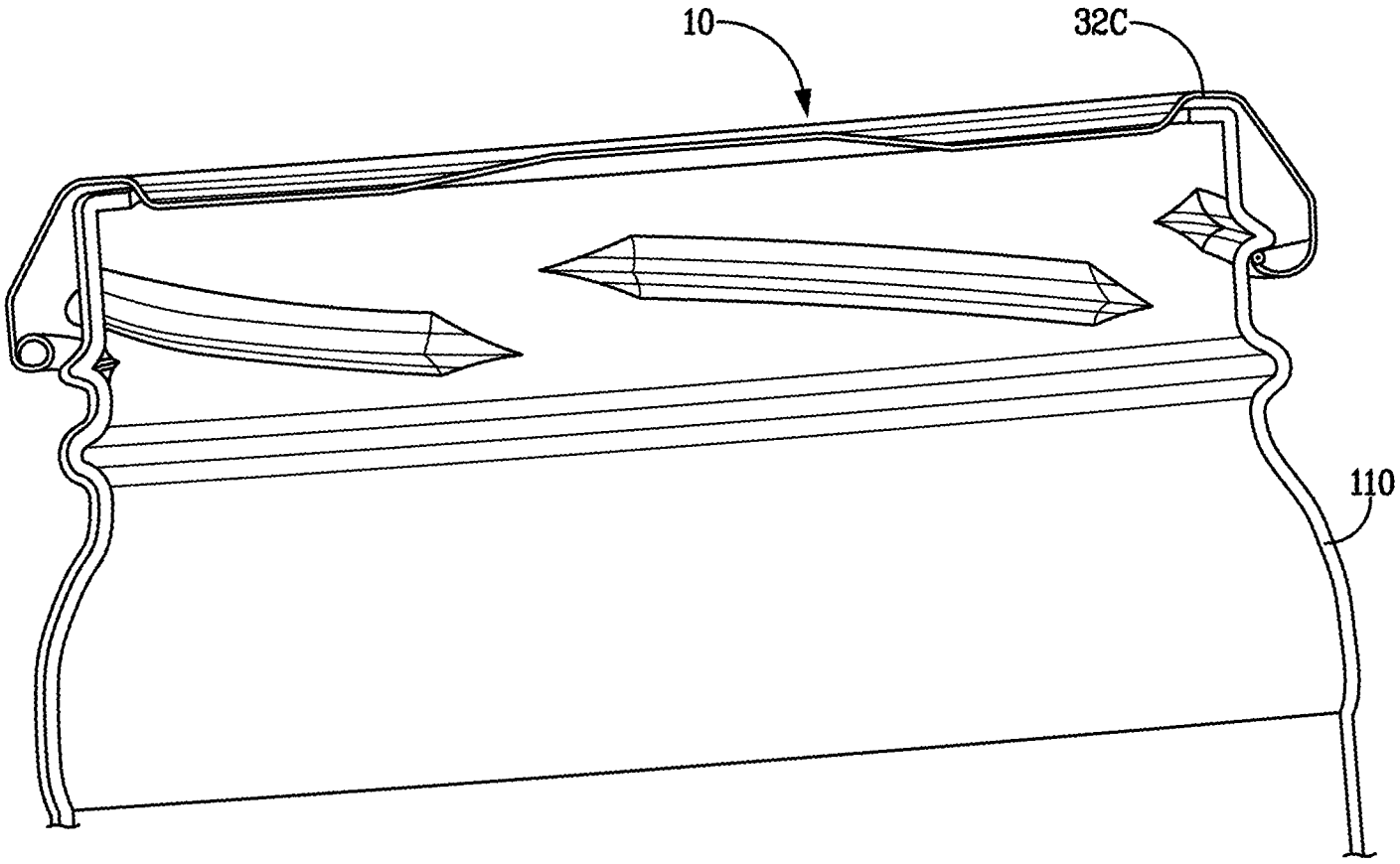
FIG. 7B is an enlarged cross section of a package having a container and a corresponding closure.
Figure 7C:
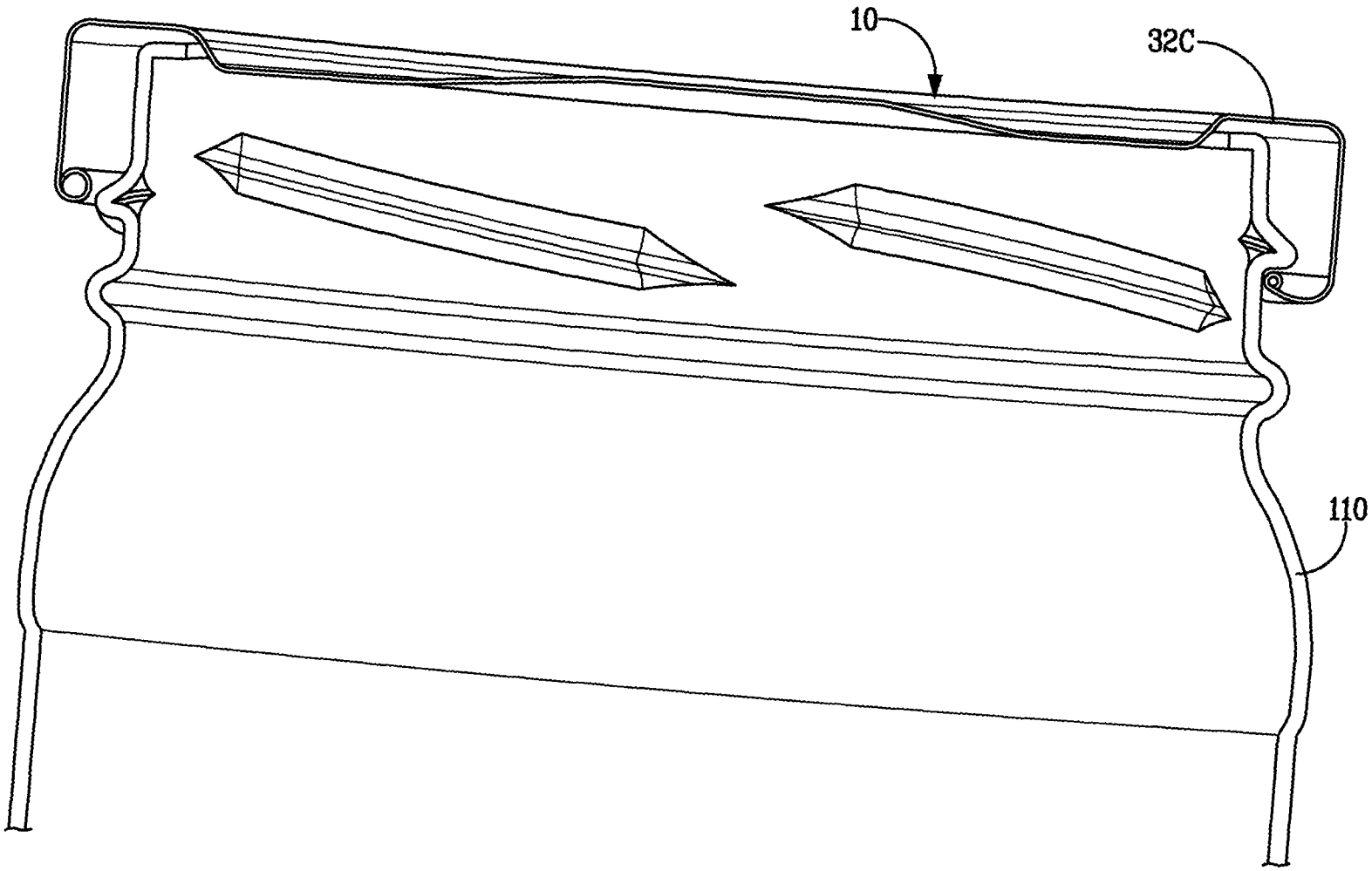
FIG. 7C is an enlarged cross section of a package having a container and a corresponding closure.

Top panel 20 includes an optional, tamper-evident button 22 that is surrounded by an approximately planar panel portion 24. Channel 30 is outboard of panel portion 24 and includes an inner shoulder 32 and a top panel wall 34. Conventional plastisol gasket or like sealant (not shown in the figures) is intended to be used in channel 30. Channel 30 in FIGS. 1A-1C is a conventional depth panel. Subsequent figures, such as FIGS. 7A and 7B, illustrate a deeper channel or narrower channel, or deeper and narrower channel, as fully described below.

Figure 2A:
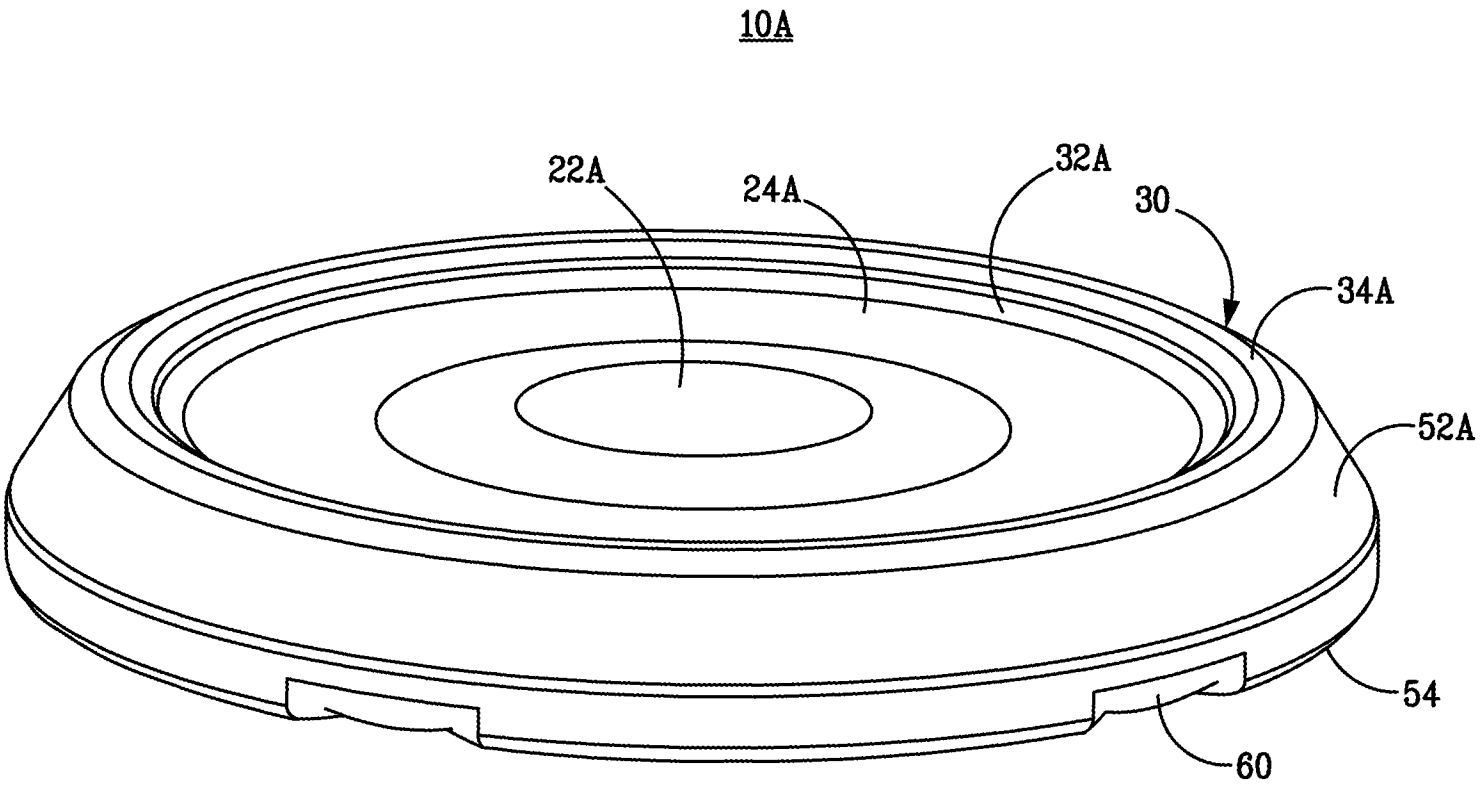
FIG. 2A is a top perspective view of a first alternative embodiment of a closure according to aspects of the present invention.
Figure 2B:
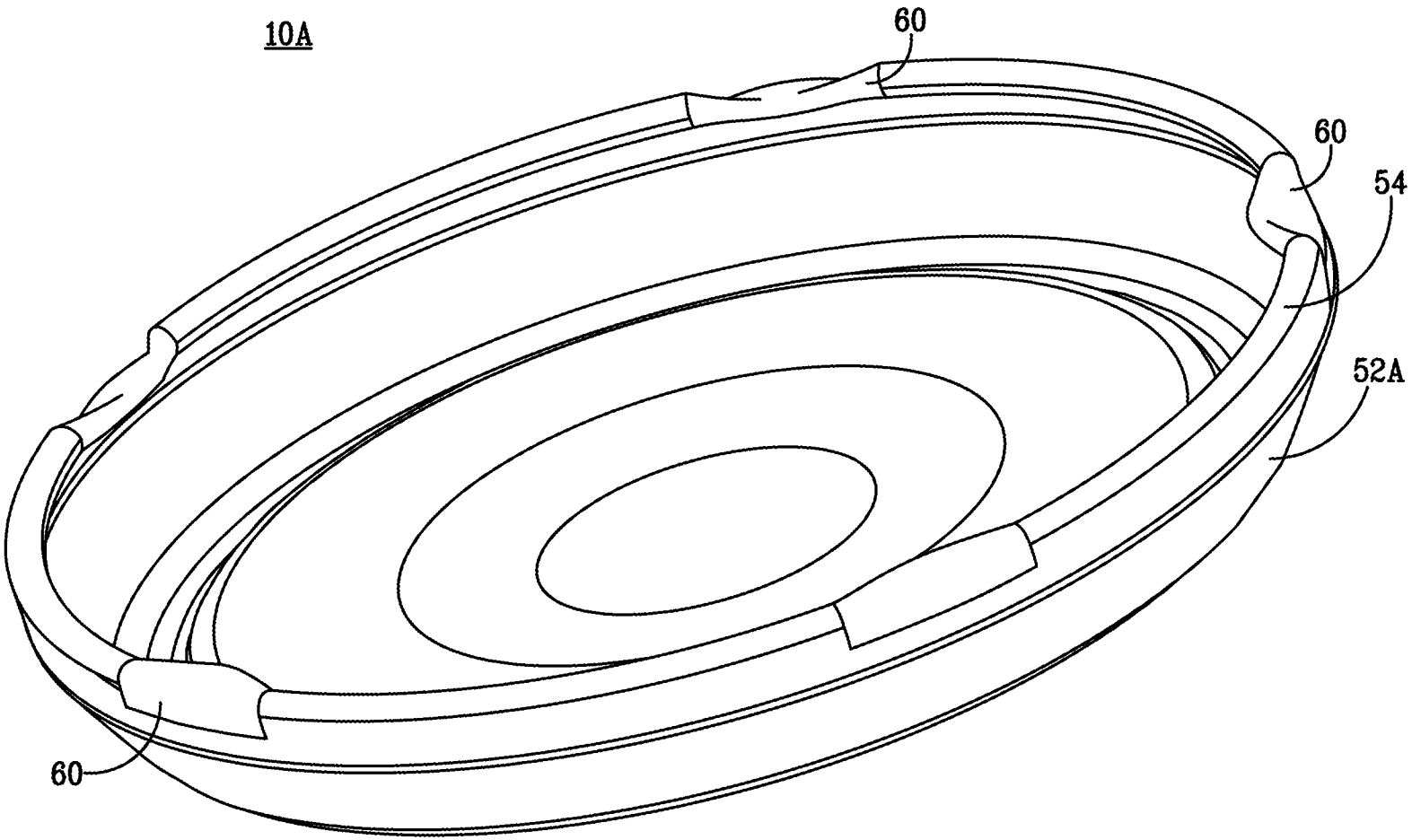
FIG. 2B is a bottom perspective view of the closure of FIG. 2A.
Figure 2C:
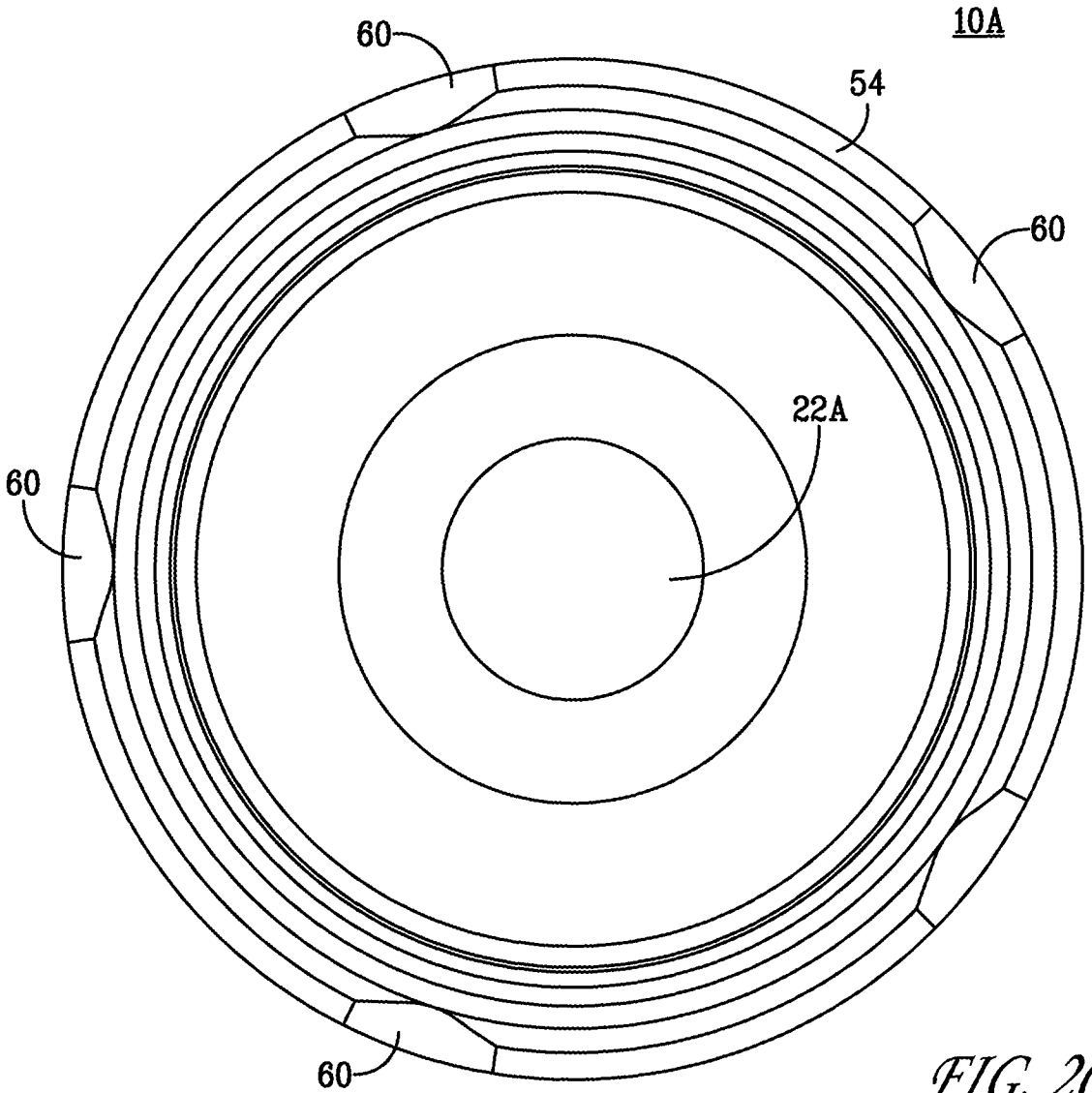
FIG. 2C is a bottom plan view of the closure of FIG. 2A.
Figure 2D:
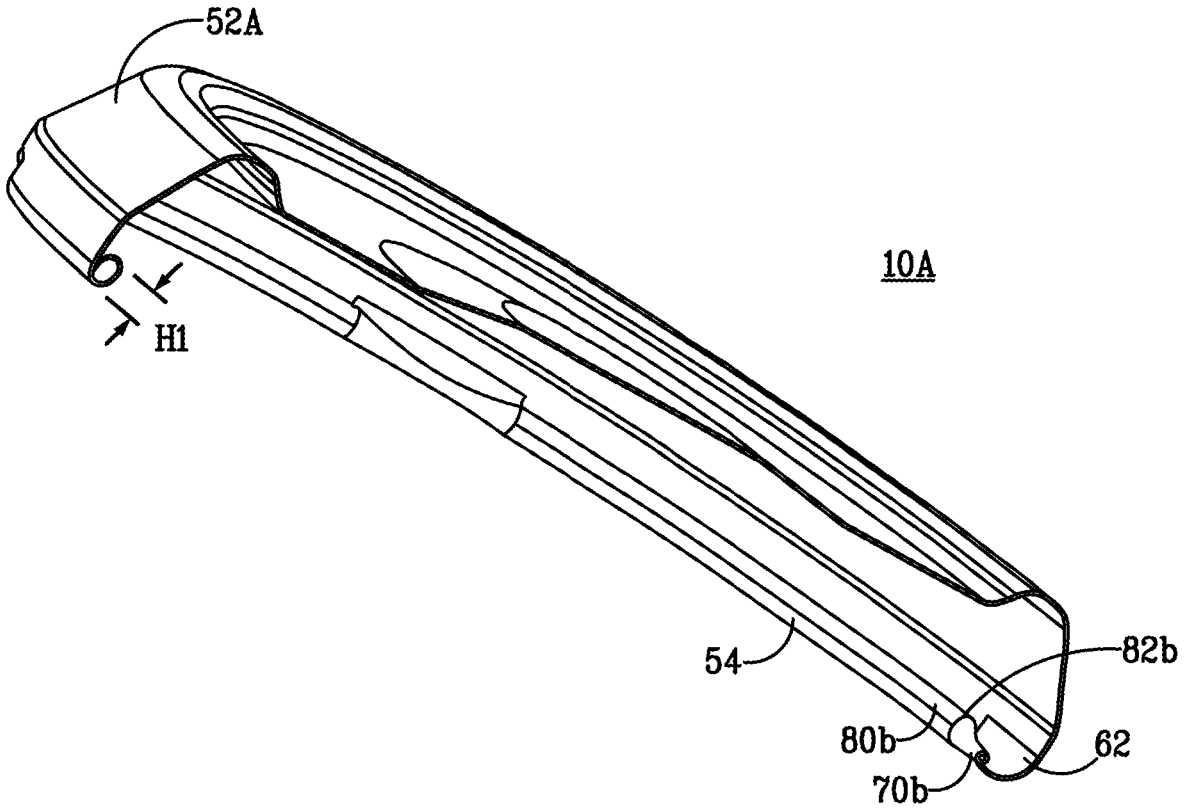
FIG. 2D is a cross sectional view of the closure of FIG. 2A.
Figure 2E:
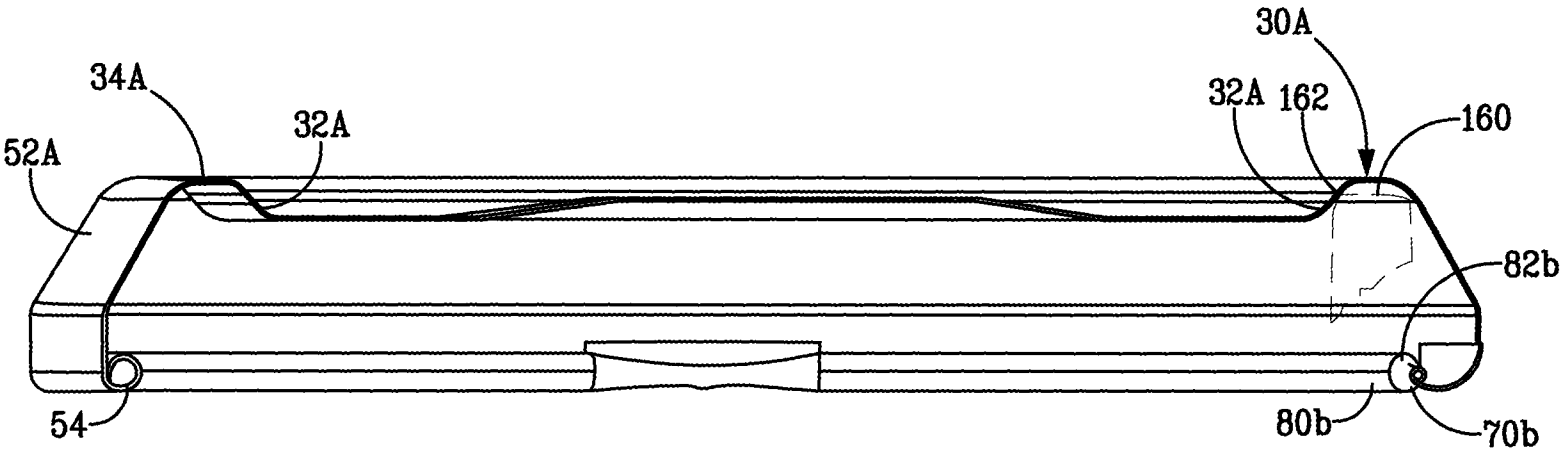
FIG. 2E is a cross sectional view of the closure of FIG. 2A.
Figure 2F:
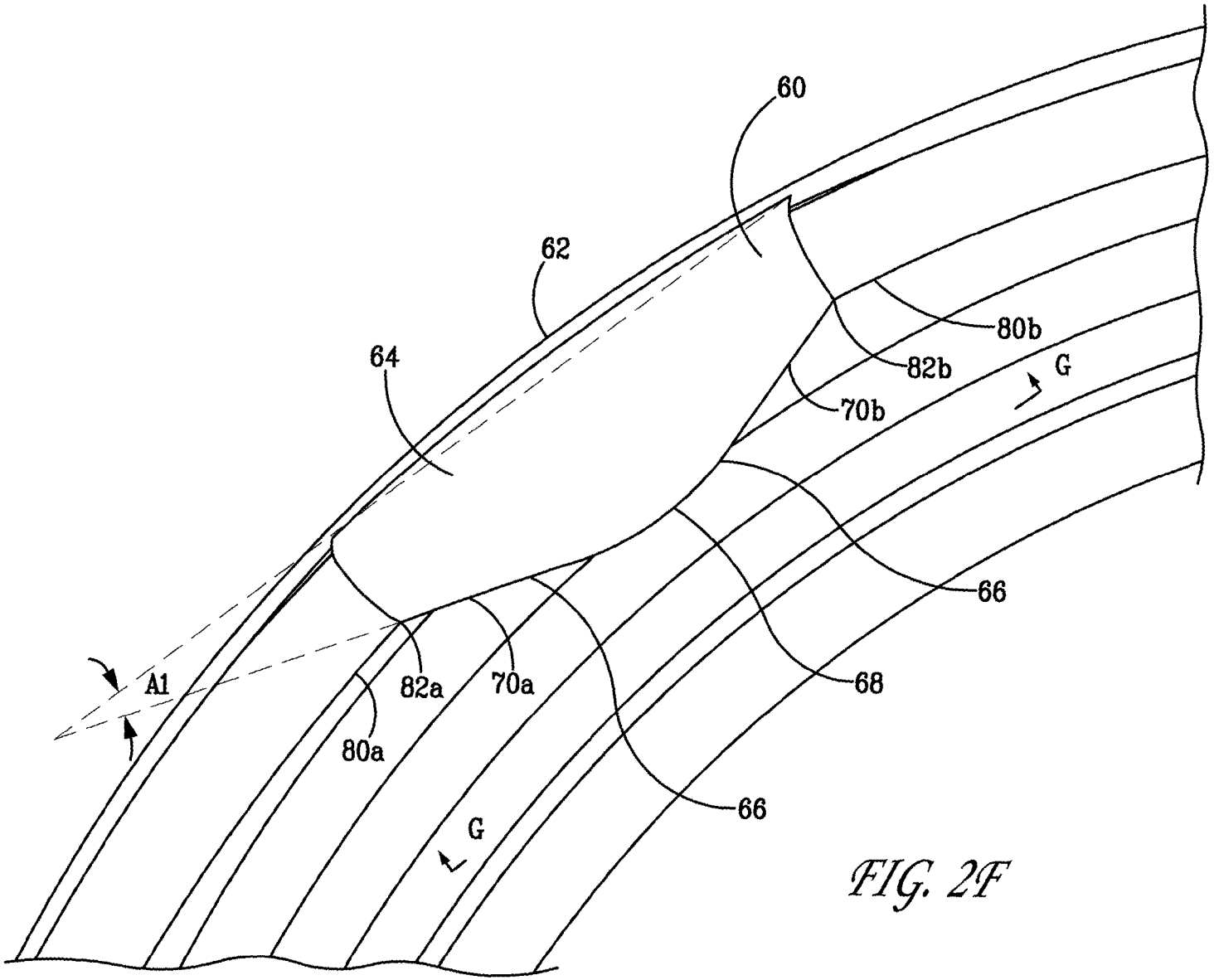
FIG. 2F is an enlarged plan view of a lug of the closure of FIG. 2A.
Figure 2G:
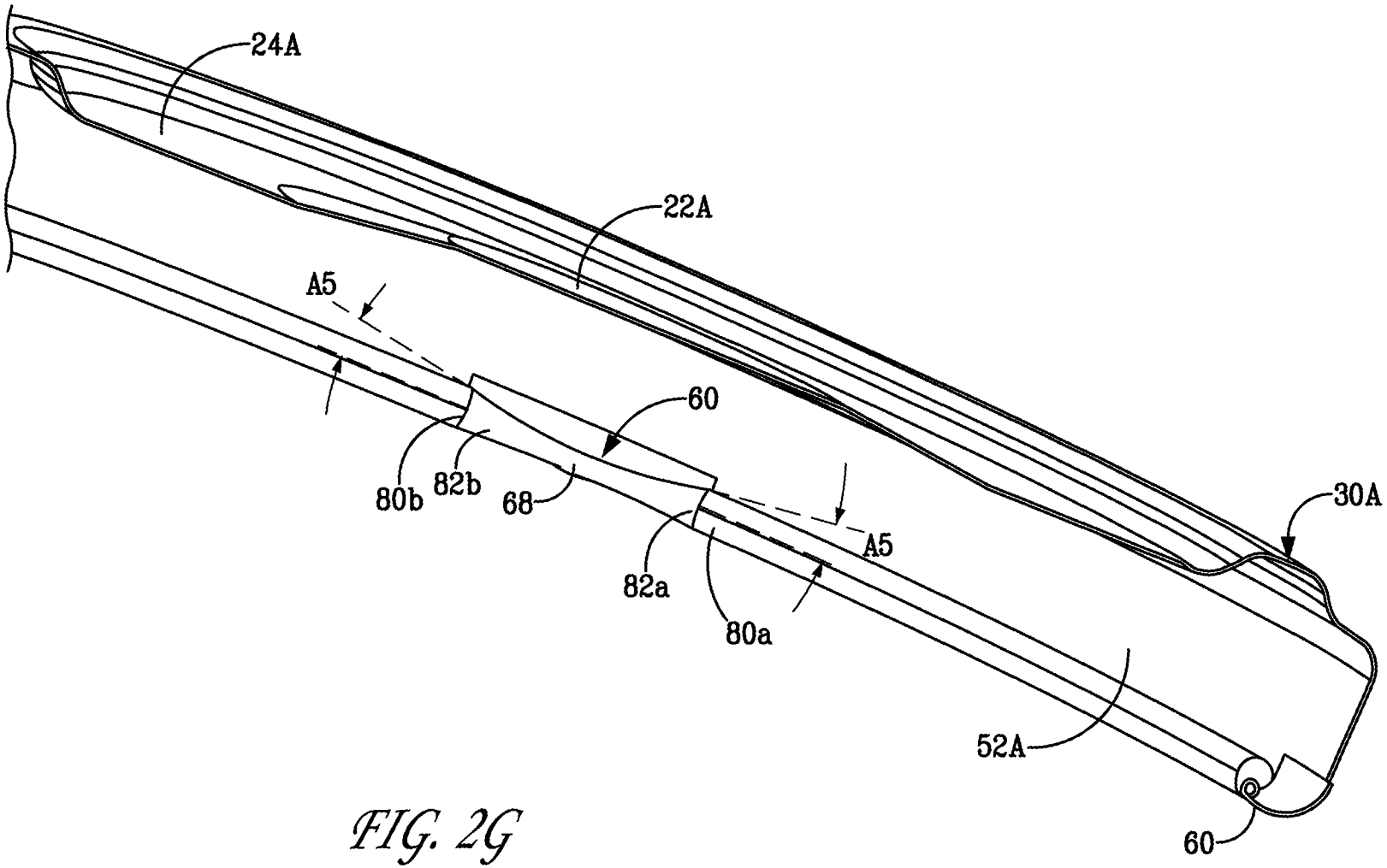
FIG. 2G is a side view of the lug of the closure of FIG. 2A taken through lines G-G in FIG. 2F.

Skirt 50 includes a skirt wall 52 that depends downwardly from an outboard side of channel top wall 34, preferably with a radius in the transition between channel top wall 34 and skirt wall 52. Skirt 52 is a conventional length and terminates at its lower end in a curl 54. Curl 54 has a height H1, which preferably is conventional, measured in a vertical orientation as shown in FIG. 2D. H1 in the embodiment shown is approximately 1.7 mm.

FIGS. 1A-1C illustrate closure 10 having a shallow channel, especially with respect to height from panel portion 24. FIGS. 2A through 2H illustrate a second embodiment closure 10A, which figures are explained now to illustrate the configuration of lugs 60. In this regard, the structure and function of the lugs are consistent throughout the embodiments, even though the present invention is not intended to be limited to the particular structure shown illustrated in the drawings and text. Rather, the invention is intended to receive the full scope defined in the claims.

Figure 2H:
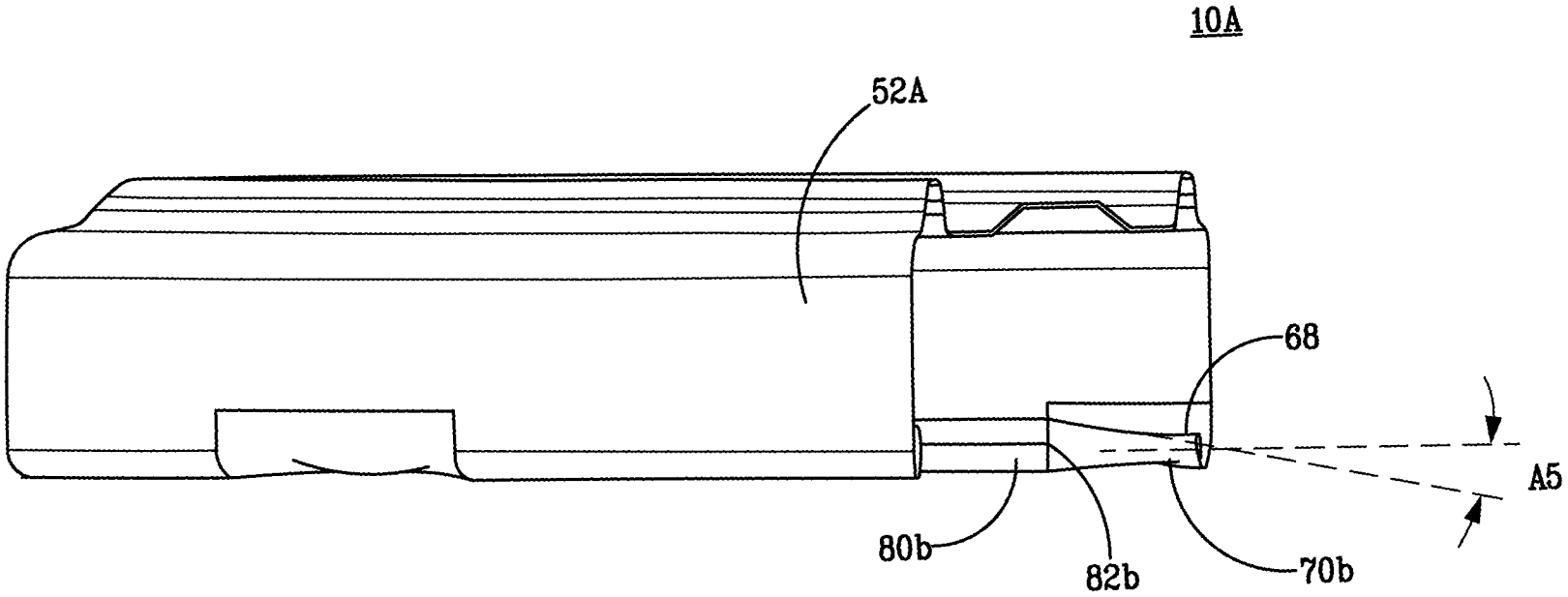
FIG. 2H is a cross sectional view of the closure of FIG. 2A illustrating the lug.

Referring to FIGS. 1 through 2H, five lugs are located equidistant about the bottom rim of skirt wall 52 or 52A. Lugs preferably are formed by material deformed from the curl. In this regard, each lug includes an upper boundary 62 that merges with skirt wall 52 or 52A, a lug body 64 that extends radially inwardly from skirt wall 52 or 52A and is defined by a lug radial surface 66, which is the inward most extent of the lug. Lug radial surface 66 includes a lug leading surface 70*a* and a lug trailing surface 70*b*. In the embodiments shown, leading and trailing surfaces 70*a* and 70*b* meet to define a tip 68 that may be shifted toward end 82*a* of lug 60 where lug 60 merges into the curl 54 at curl leading portion 80*a* and curl trailing portion 80*b*.

For each lug 60, lug leading surface 70*a* is the leading edge when the closure is twisted onto right hand threads. Lug leading surface forms a leading edge taper angle A1 from horizontal of no more than about 25 degrees, preferably no more than 20 degrees, more preferably no more than about 15 degrees, more preferably between 6 and 15 degrees, and preferably about 10 degrees. The lower limit on the leading edge taper angle is the practical geometric and manufacturing limit on forming a lug that has sufficient radial dimension, and preferably is approximately three degrees. The leading edge taper angle A1 may or may not be straight.

Lug trailing surface 70*b* preferably has a lug trailing edge taper angle that is the same as leading edge taper angle A1, such that lug 60 is symmetrical about a vertical, radial plane bisecting lug 60 at tip 68. Alternatively, the trailing edge taper angle may be less than the leading edge taper angle such that tip 68 is offset from the center. As shown for example in FIGS. 2G and 2H, the trailing edge 70*b* tapers in thickness from the curl height to the minimum lug thickness, which in the figures is at tip 68, which preferably is less than 25 degrees, preferably between 10 and 20 degrees, more preferably between 12 and 18 degrees, and in the embodiment shown approximately 15 degrees.

As shown in FIGS. 2E and 7A-7C, shoulder 32A is configured and sized to engage an inside surface 162 of rim 160 of the bottle finish when the closure is fully applied such that the shoulder enhances roundness of the finish, as more fully explained below. Rim 160 is shown in relief for clarity.

Figure 3A:
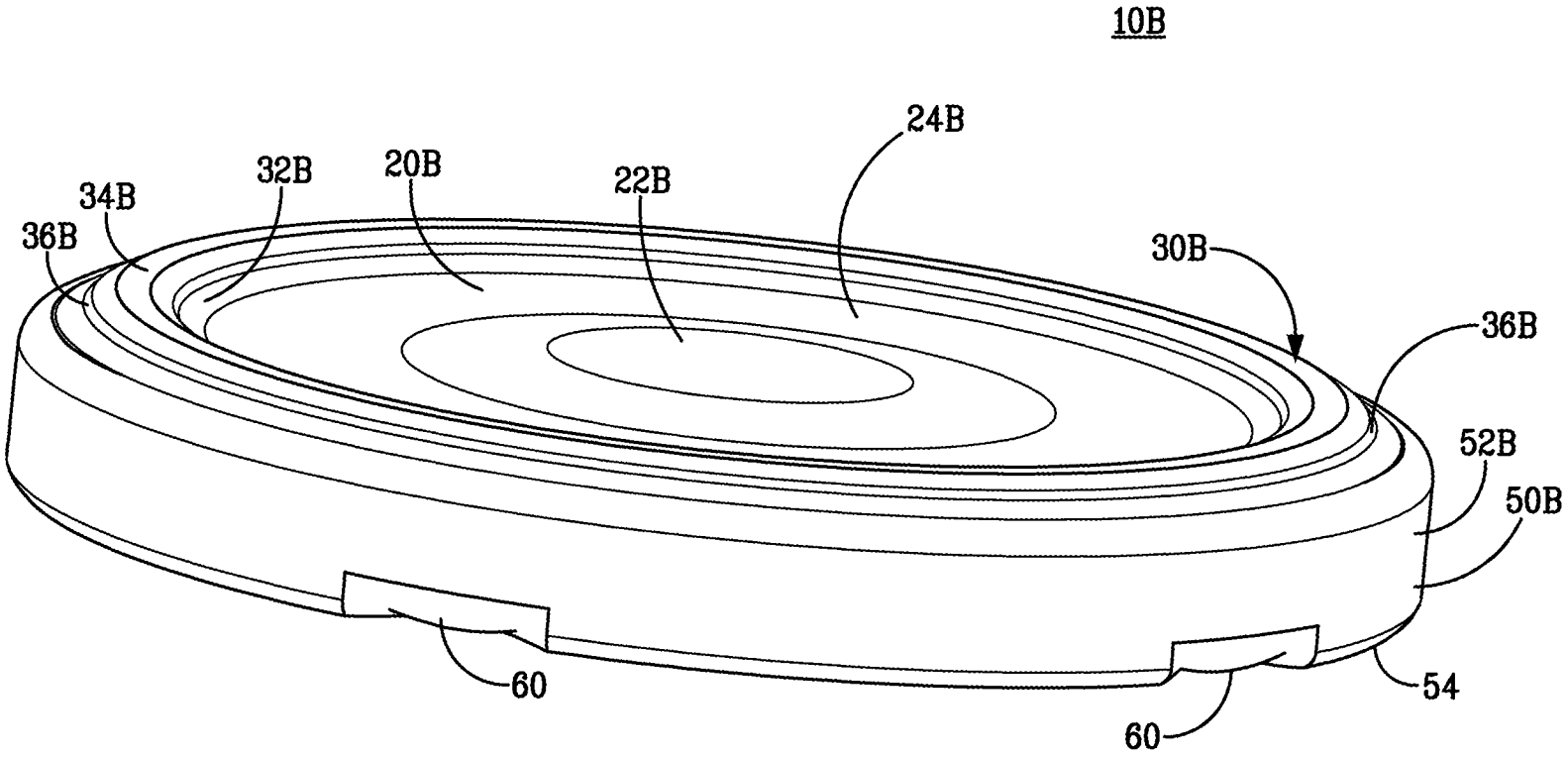
FIG. 3A is a top perspective view of another embodiment of the closure.
Figure 3B:
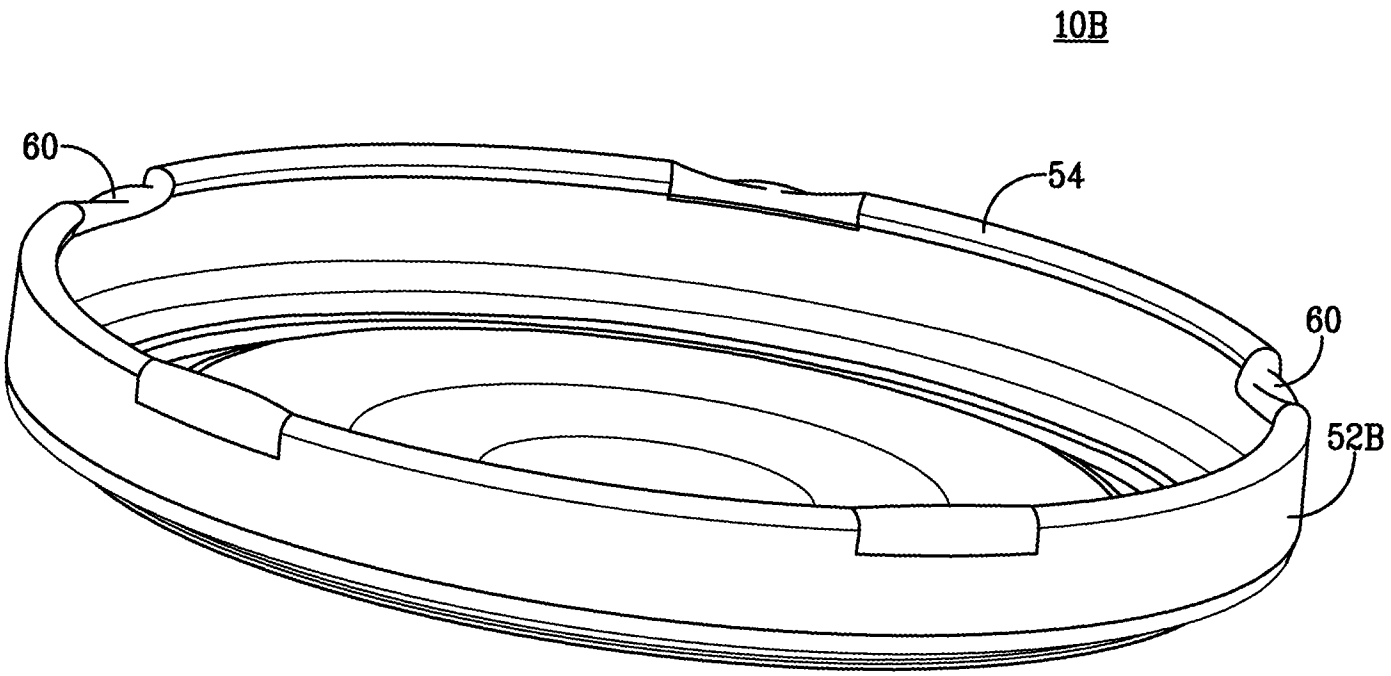
FIG. 3B is a bottom perspective view of the embodiment of FIG. 3A.
Figure 3C:
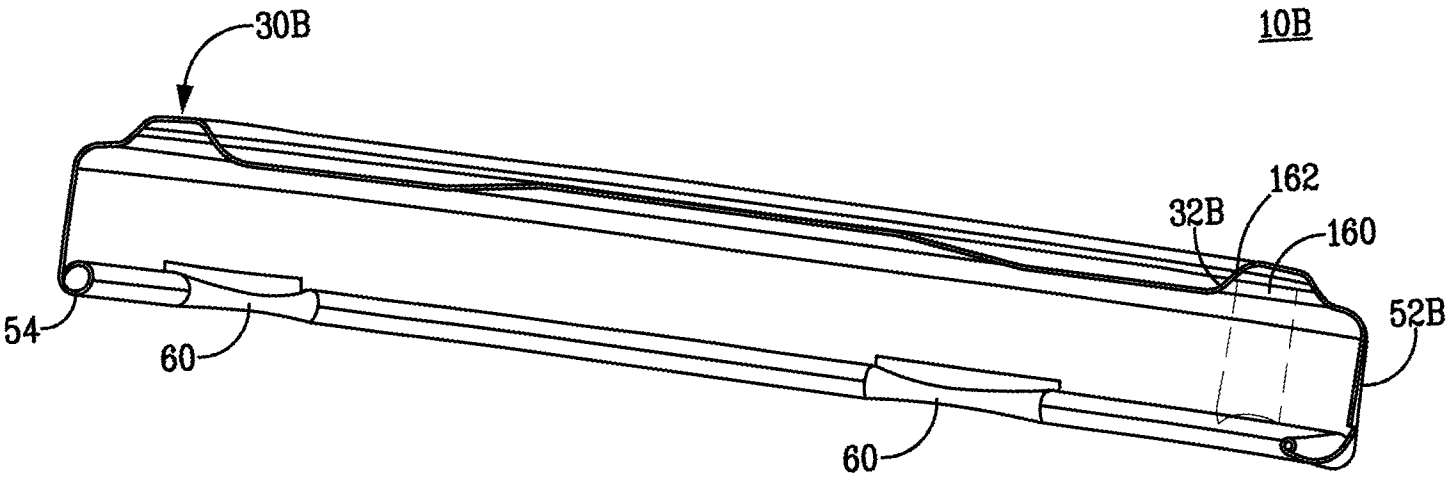
FIG. 3C is a cross section view of the embodiment of FIG. 3A.

FIGS. 3A, 3B, and 3C illustrate another embodiment 10B of the closure. Closure 10B includes top panel 20B, a stepped channel 30B, a skirt 50B, and five lugs 60. Top panel 20B includes an optional, tamper-evident button 22B that is surrounded by an approximately planar panel portion 24B. Channel 30B is outboard of panel portion 24B and includes an inner shoulder 32B that rises from panel portion 24B to an upper wall 34B. Conventional plastisol gasket or like sealant (not shown) is intended to be used in channel 30. Channel 30B includes a step 36B.

Skirt 50B includes a skirt wall 52B that depends downwardly from an outboard side of step 36B, preferably with a radius in the transition between step 36B and skirt wall 52B. Skirt 52B is a conventional length and terminates at its lower end in a curl 54 and five equidistant lugs 60. Curl 54 and lugs 60 are as described above with respect to FIGS. 2A-2H.

As shown in FIGS. 3C and 7A-7C, a shoulder 32B is configured and sized to engage an inside surface 162 of rim 160 of the bottle finish when the closure is fully applied such that the shoulder enhances roundness of the finish, as more fully explained below. Also, channel 30B may be sized to enable step 36B to engage an outer portion of rim 160. Rim 160 is shown in relief for clarity.

Figure 4A:
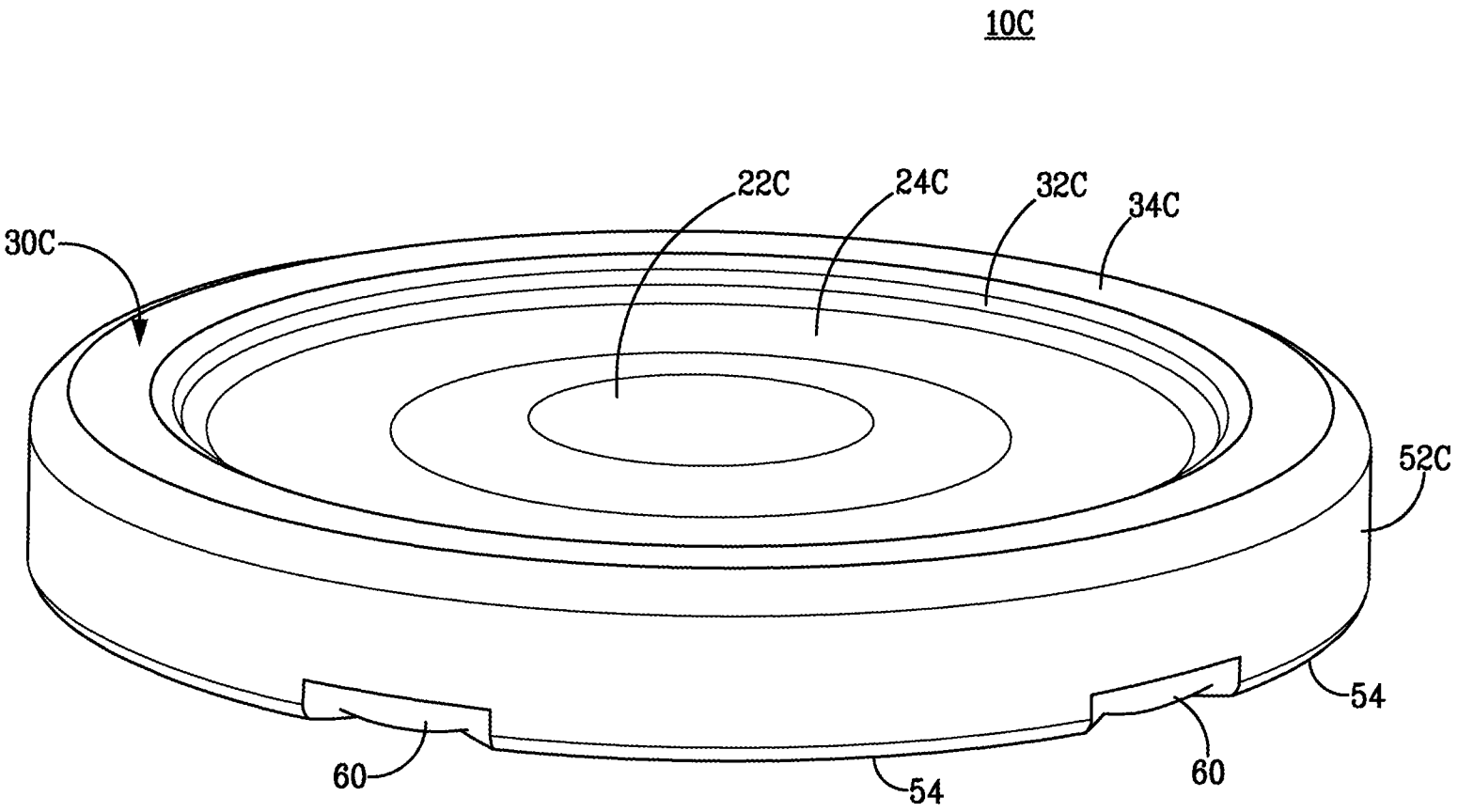
FIG. 4A is a top perspective view of another embodiment of the closure.
Figure 4B:
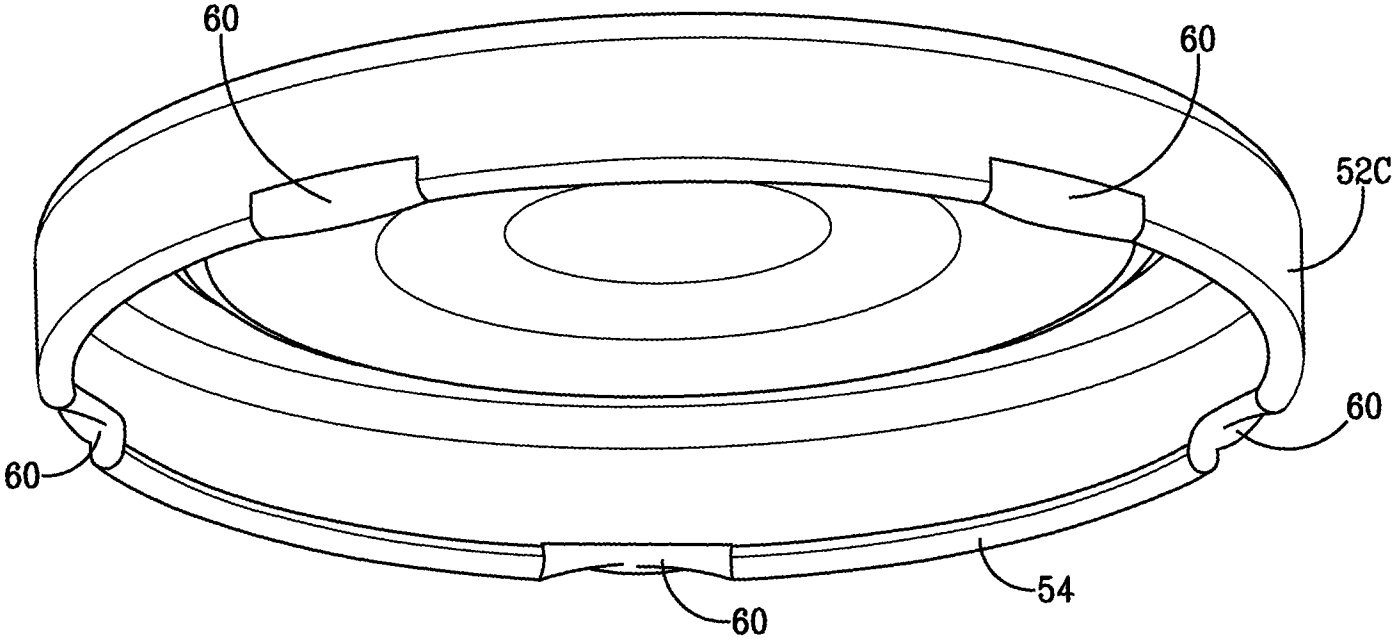
FIG. 4B is a bottom perspective view of the embodiment of FIG. 4A.
Figure 4C:
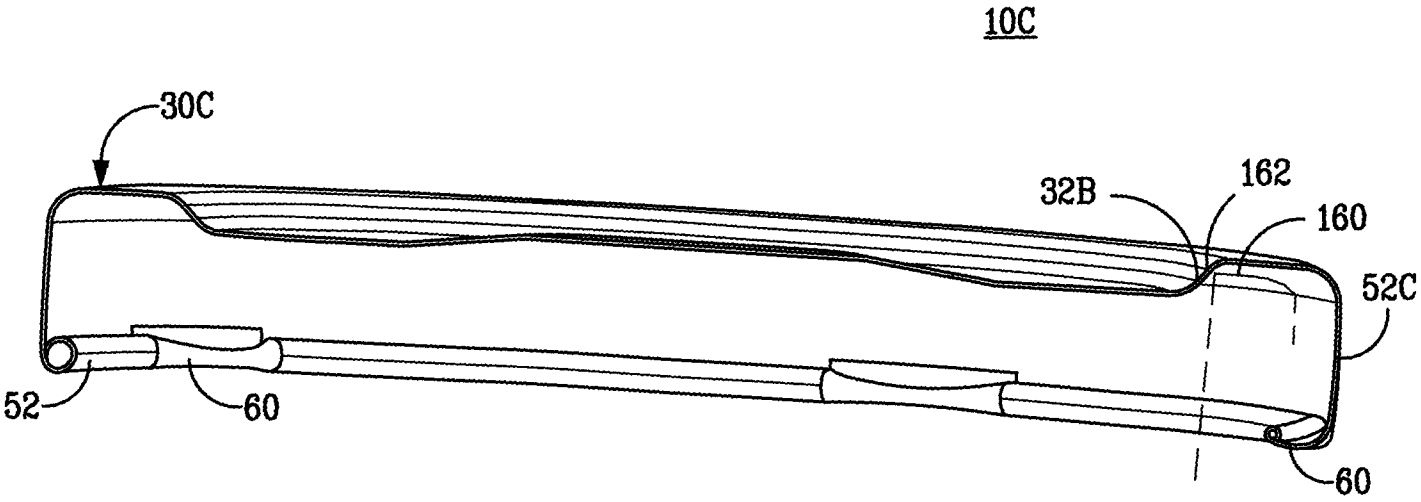
FIG. 4C is a cross section view of the embodiment of FIG. 4A.

FIGS. 4A, 4B, and 4C illustrate another embodiment 10C of the closure. Closure 10C includes top panel 20C, a channel 30C, a skirt 50C, and five lugs 60. Top panel 20C includes an optional, tamper-evident button 22C that is surrounded by an approximately planar panel portion 24C. Channel 30C is outboard of panel portion 24C and includes an inner shoulder 32C that rises from panel portion 24C to an upper wall 34C. Conventional plastisol gasket or like sealant is intended to be used in channel 30.

Skirt 50C includes a skirt wall 52C that depends downwardly from an outboard side of step 34C, preferably with a radius in the transition between step 34C and skirt wall 52C. Skirt 52C is a conventional length and terminates at its lower end in a curl 54 and five equidistant lugs 60. Curl 54 and lugs 60 are as described above.

As shown in FIGS. 4C and 7A-7C, a shoulder 32C is configured and sized to engage an inside surface 162 of rim 160 of the bottle finish when the closure is fully applied such that the shoulder enhances roundness of the finish, as more fully explained below. Rim 160 is shown in relief for clarity.

Bottle 110 preferably is a blow molded bottle formed of a polyester, such as polyethylene terephthalate, but may be formed of other plastics, such as polypropylene and the like. The closures described above are beneficial when used with hot Tillable container, especially with containers blown and trimmed finish because blow-trim finishes are prone to squaring. The present invention however is not limited to blow-trim finishes. The bottle material for hot-Tillable bottles typically have an intrinsic viscosity 0.76-0.84.

Figure 5:
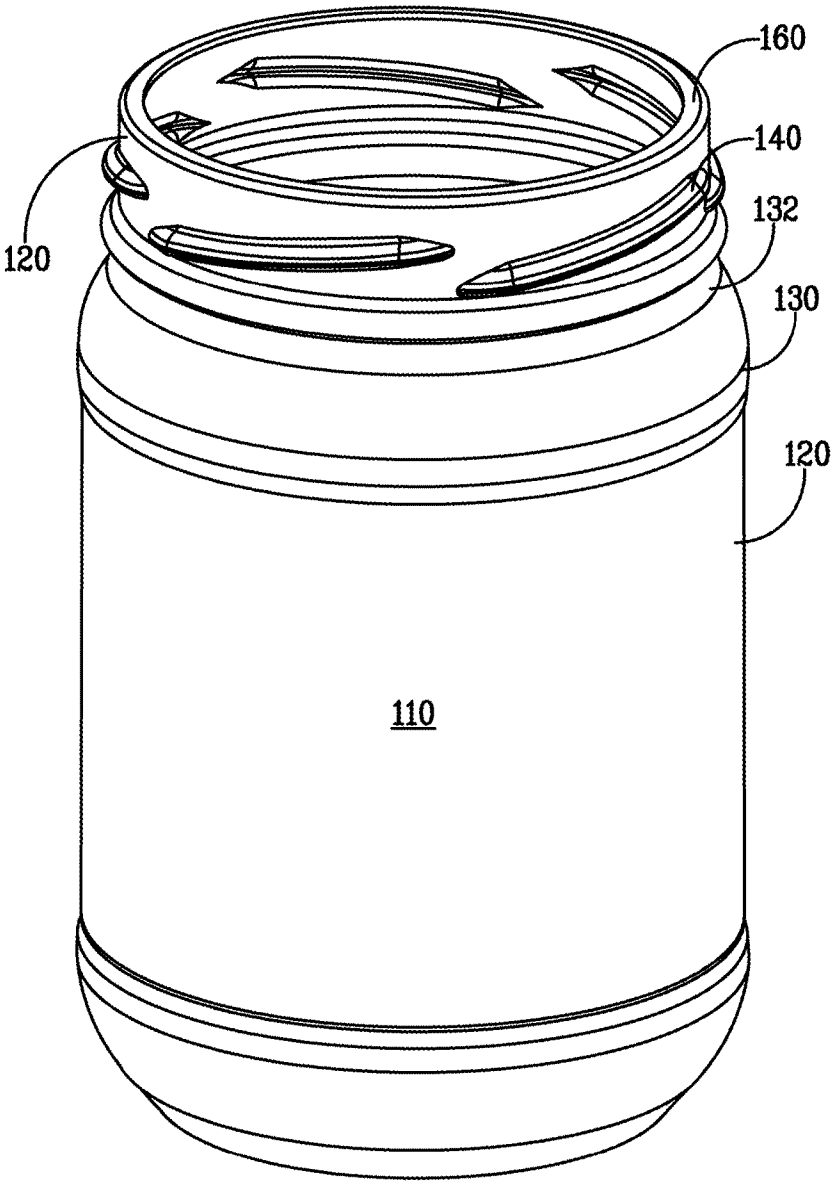
FIG. 5 is a perspective view of a container showing a finish according to aspects of the present invention.
Figure 6B:
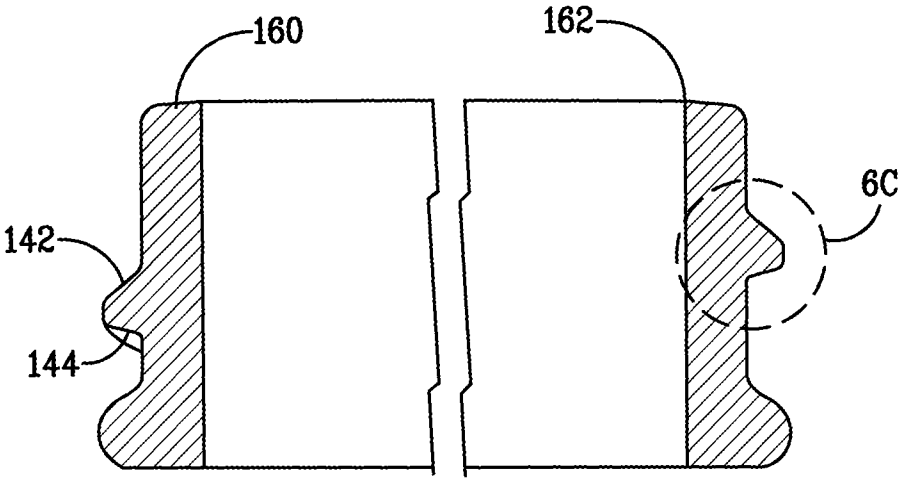
FIG. 6B is an enlarged cross sectional view of the finish of FIG. 6A.
Figure 6C:
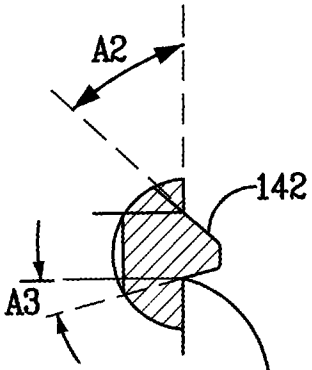
FIG. 6C is an enlarged view of the cross section of the thread shown in FIG. 6B.
Figure 6A:
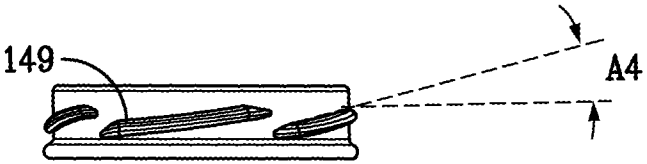
FIG. 6A is an isolated side view of the finish of the bottle of FIG. 5, illustrating the threads.

As best shown in FIG. 5, neck 130 includes a shoulder 132 on cylindrical body 120 and a right angle cylindrical finish that includes five thread segments 140. The finish terminates in circular rim 160. Referring to FIGS. 6A, 6B, and 6C to illustrate aspects of each thread segment 140, the thread includes an upper thread surface 142 and a lower thread surface 144, which respectively define an upper thread taper angle A2 and a lower thread taper angle A3. And the thread also defines a thread pitch angle A4. For example, the thread pitch angle A4 may be 6.74°.

Upper thread taper angle A2 shown in the figures is 50 degrees. The present invention encompasses any angle A2 that can work with lower thread taper angle A3 according to conventional plastic thread practice in the bottle and closure field. Preferably angle A2 is between 40 degrees and 60 degrees.

Lower thread angle A3 is defined by the lower thread surface 144 for the lugs during application of the closure. Angle A3 preferably no more than 25 degrees, preferably is between 5 and 22 degrees, more preferably between 5 and 20 degrees, and in the embodiment shown, approximately 15 degrees. Alternatively, and as indicated schematically by the dashed line 149 of FIG. 6A, each thread segment 140 may be divided into an upper thread portion, which is inclined at an angle A4, and (optionally) a lower thread portion that has a pitch angle that is less than the pitch angle of the thread upper portion, and preferably is near zero.

Upon application of any of the closures 10, 10A, 10B, and 10C to the finish of bottle 110, a user applies a clockwise rotation to the closure until the upper surface of one or more lugs 60 engage the uppermost end tip of the thread 140 and then engage the contact surface or lower thread surface 144. Because the configuration of lug 60 is relatively flexible compared with prior art lugs, lug 60 should tend to deflect more than prior art closures and will have less tendency to dig in or deform the surface of threads 140. And lugs 60 should create lower horizontal force pushing inward toward the axis of the container that would tend to exacerbate the squaring problem when the finish is at elevated temperate. Further the lower taper angle A3 of the thread profile creates a flatter surface than many conventional bottle threads, which also diminishes the inward force on the container.

A leading edge vertical taper angle A5 (shown in relation to end 82*a*) reflects the decrease in vertical height from curl leading portion 80*a* of curl 54 to tip 68. Vertical taper angle A5 may be configured to roughly match the thread pitch angle A4 to enhance the above benefits. Preferably vertical taper angle A5 is within 0.5° of thread pitch angle A4, more preferably with 0.4° and preferably within 0.1°. In this regard, according to another means for describing the structure, vertical taper angle A5 and thread pitch angle A4 may be each preferably no more than 25 degrees, preferably between 5 degrees and 15 degrees, and more preferably approximately 10 degrees.

The angle-flat portion would also diminish inward radial forces during application.

Upon further application of closure 10, 10A, 10B, and 10C onto the finish of bottle 110, after sufficient clockwise rotation, rim 160 of bottle 110 is driven (relatively) upward into or relative to channel 30 such that the inner rim 164 of 162 embeds into the gasket such that the gasket is supported by closure shoulder 32, 32A, 32B, and 32C (and step 36B of closure 10B may also contact an outer portion of rim 160) as needed to resist or diminish the squaring or like deformation force of lugs 60 and to at least partially correct or diminish out of roundness of the finish, creating a more robust seal and package.

The present invention has been described using several illustrations. The present invention is not intended to be limited to the structures illustrated above. The invention is intended to get the full scope as expressly defined in the claims. For merely one example, all of the embodiments employ five lugs, even though the present invention encompasses closures and packages having more or fewer than five lugs unless expressly stated in the claims. The closure shown is a standard 63 mm closure. The inventors surmise that a closure larger than a 43 mm, size, such as at least 48, at least 58 mm, or at least 63 mm closures may be employ the structure and function described herein.

What is claimed is:

1. A lug closure comprising: a central top panel; an annular channel outboard of the top panel; a downwardly extending skirt outboard of the channel, the skirt terminating at an inward curl that defines a curl height; and lugs formed in the curl, each one of the lugs including a body that extends radially inwardly from the skirt, the body including: a leading edge that merges into a leading portion of the curl, the leading edge tapers in thickness from the curl height to a minimum lug thickness at a tip of the lug such that the leading edge at the tip of the lug is located below an uppermost edge of the curl, the leading edge taper forming a leading edge vertical taper angle (A5) of no more than 25 degrees from horizontal, and a trailing edge that merges into a trailing portion of the curl, the trailing edge tapers in thickness from the curl height to the minimum lug thickness at the tip of the lug.

2. A package for food or beverage contents, the package including: a wide mouth plastic hot fillable container, the container having a finish including threads, at least an upper portion of the threads defining a thread pitch angle; and a lug closure of claim 1.

3. The lug closure of claim 1, wherein the lug thickness tapers at an angle (A5) of between 6 and 12 degrees.

4. The lug closure of claim 1, wherein the lug is approximately symmetric about a vertical, radial plane and the lug has a maximum radial dimension located approximately equidistant from its ends.

5. The lug closure of claim 1, wherein the top panel includes a button and the channel includes a shoulder on an inboard side.

6. The lug closure of claim 5, wherein the shoulder merges into the top panel and the shoulder is configured and sized to be disposed proximate inside surface of a bottle finish such that the shoulder and the inside surface are separated by less than 0.025 inches relative to a longitudinal center axis of the closure, whereby the shoulder is configured to enhance roundness of the finish.

7. The package of claim 2, wherein the container has a blow-molded and trimmed finish.

8. The package of claim 2, wherein the thread pitch angle of the finish is within four degrees of the vertical taper angle (A5) of the leading edge of the lug.

9. The package of claim 2, wherein the thread pitch angle is less than the vertical taper angle (A5) of the leading edge of the lug.

10. The package of claim 2, wherein the leading edge taper angle and thread pitch angle are each between 5 and 22 degrees.

11. The package of claim 2, wherein the trailing edge taper angle is between 10 and 20 degrees.

12. The package of claim 2, wherein the threads are individual thread segments, each thread further comprising a lower portion that has a pitch angle that is less than the pitch angle of the thread upper portion.

* * * * *